US007007478B2

(12) United States Patent
Dinu

(10) Patent No.: US 7,007,478 B2
(45) **Date of Patent: *Mar. 7, 2006**

(54) MULTI-VENTURI TUBE FUEL INJECTOR FOR A GAS TURBINE COMBUSTOR

(75) Inventor: Constantin Alexandru Dinu, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/879,059

(22) Filed: Jun. 30, 2004

(65) Prior Publication Data

US 2006/0000217 A1 Jan. 5, 2006

(51) Int. Cl.
*F02C 1/00* (2006.01)
*F02G 3/00* (2006.01)

(52) U.S. Cl. ..... 60/737; 60/723; 60/39.822

(58) Field of Classification Search ..... 60/737, 60/723, 740, 742, 747, 39.822
See application file for complete search history.

(56) References Cited

U.S. PATENT DOCUMENTS 3,143,401 A * 8/1964 Lambrecht ..... 48/180.1
3,643,431 A * 2/1972 Jamieson ..... 60/738
4,226,087 A * 10/1980 Spadaccini ..... 60/749
4,356,698 A * 11/1982 Chamberlain ..... 60/733
4,845,952 A 7/1989 Beebe
4,966,001 A 10/1990 Beebe
5,161,366 A * 11/1992 Beebe ..... 60/777
5,826,429 A * 10/1998 Beebe et al. ..... 60/723
5,850,731 A * 12/1998 Beebe et al. ..... 60/778
5,924,276 A * 7/1999 Mowill ..... 60/39.23
6,220,034 B1 * 4/2001 Mowill ..... 60/737
6,250,066 B1 * 6/2001 Lawrence et al. ..... 60/39.23
6,442,939 B1 * 9/2002 Stuttaford et al. ..... 60/737
6,460,345 B1 * 10/2002 Beebe et al. ..... 60/777
6,886,341 B1 * 5/2005 Inoue et al. ..... 60/737

OTHER PUBLICATIONS

Application of Constantin Dinu et al, U.S. Appl. No. 10,879,102, filed Jun. 30, 2004.
Application of Constantin Dinu, U.S. Appl. No. 10,879,279, filed Jun. 30, 2004.

* cited by examiner

*Primary Examiner*—William H. Rodriguez
(74) *Attorney, Agent, or Firm*—Nixon & Vanderhye P.C.

(57) ABSTRACT

A combustor for a gas turbine includes a main fuel injector for receiving compressor discharge air and mixing the air with fuel for flow to a downstream catalytic section. The main fuel injector includes an array of venturis each having an inlet, a throat and a diffuser. A main fuel supply plenum between forward and aft plates supplies fuel to secondary annular plenums having openings for supplying fuel into the inlet of the venturis upstream of the throat. The diffusers transition from a circular cross-section at the throat to multiple discrete angularly related side walls at the diffuser exits without substantial gaps therebetween. With this arrangement, uniform flow distribution of the fuel/air, velocity and temperature is provided at the catalyst inlet.

14 Claims, 6 Drawing Sheets

MULTI-VENTURI TUBE FUEL INJECTOR FOR A GAS TURBINE COMBUSTOR

BACKGROUND OF THE INVENTION

The present invention relates to a fuel injection arrangement for multi-venturi tube (MVT) type main fuel injectors for a gas turbine combustor and particularly relates to fuel injection locations within the venturi for optimizing fuel distribution, fuel/air mixing and sensitivity to air mass flow distribution among the venturis.

A venturi is an aerodynamic device consisting of a converging inlet, a throat and a diffuser. Typically, venturis are circular in cross-section and are sometimes used in fuel injectors in combustors for certain types of gas turbines. The venturis in the combustors of these turbines precondition the flow before the fuel/air mixture flows into a catalyst inlet, provide for fuel injection and afford pre-mixing of the fuel/air mixture with minimum pressure drop. See for example U.S. Pat. Nos. 4,845,952 and 4,966,001. The uniformity of the fuel/air mixture at the catalyst inlet must be maintained over a large cross-sectional area. In prior applications, e.g., the above patents, fuel/air mixing is accomplished by distributing the fuel among a large number of venturis, e.g., over one hundred, that populate the combustor cross-section followed by aerodynamic mixing inside the venturi tubes as well as in the downstream region between the exit planes of the venture tubes and the catalyst inlet.

Because a high level of fuel/air uniformity is required at the catalyst inlet and mixing inside the venturi tubes is limited, large recirculation regions that form at the venturi exits are typically relied upon for complete mixing. However, there is a potential for flammable mixture formation in the wakes of the venturi gaps, i.e., the areas between the diffuser exit openings downstream from the venturis. This leads to potential deleterious flame-holding events. Further, in prior venturi designs, fuel injection supply holes were located at the throat of the venturi tubes where the primary fluid velocity is highest. This takes advantage of the low static pressure at the throat. However, it has been found that such fuel supply location vis-a-vis the venturi is not optimized for fuel injection and efficient mixing.

The amount of mixing that takes place inside the venturi tube is directly related to jet penetration which in turn depends on the pressure ratio across the fuel injection holes and on the jet momentum ratio (between the jet and the mainstream). The pressure ratio is very low particularly at low loads (low fuel flow) and the fuel jet is weak (jet momentum is low compared to the momentum of the main flow). Fuel supply jets located at the venturi throats are also sensitive to mass flow distribution among venturis. That is, if one venturi flows more air than another, the velocity at the throat will be higher (static pressure would be lower) in that venturi and the venturi will suction a greater magnitude of fuel. One or more fuel jets at throat locations of the venturi also upset the boundary layer and cause flow separation inside the venturi diffuser with adverse impact on flame holding resistance. Additionally, the flow separation inside the diffuser may be a result of flow disturbance caused by the wakes at the venturi exits.

Further, from the standpoint of the operational life of the catalyst, efficient and safe operation of a catalytic combustor requires the catalyst to be active and fueled over a wide range of loads. Thus, it is required to maintain optimum fuel distribution among the venturi tubes over the entire operational range of flows in order to meet the fuel/air uniformity which is critical to quality at the catalyst inlet. Consequently, there is a need for a multi-venturi tube fuel injection system for optimizing uniform fuel/air mixtures inside the venturis, improving fuel distribution among the venturis and reducing the sensitivity of fuel injection to air mass flow distribution among the venturis.

BRIEF DESCRIPTION OF THE INVENTION

In accordance with the preferred aspect of the present invention, a multiplicity of venturis are provided in the flow path through the combustor upstream of the catalyst inlet. Each venturi tube includes a convergent inlet, a throat and a diverging outlet, i.e., a diffuser. At least one and preferably a plurality of fuel injection supply holes are provided in the convergent inlet between the throat and a plane normal to and passing through an inlet opening of the convergent inlet.

In a preferred aspect of the present invention, there is provided a combustor for a gas turbine, a main fuel injector comprising at least one venturi including a convergent inlet, a throat, and a diffuser for flowing a fuel/air mixture therethrough in a generally axial direction for exit from the diffuser, the inlet having at least one fuel supply hole for supplying fuel into the venturi at a location axially upstream from the throat.

In another aspect of the present invention, there is provided a combustor for a gas turbine, a main fuel injector comprising an array of venturis each including a convergent inlet, a throat, and a diffuser for flowing a fuel/air mixture therethrough in a generally axial direction for exit from the diffuser, a forward plate and an aft plate surrounded by an enclosure defining a fuel supply plenum between the plates; each plate having a plurality of openings for receiving the venturis; each venturi inlet having at least one fuel supply hole for supplying fuel from the fuel supply plenum into the venturi at a location axially upstream from the throat.

DETAILED DESCRIPTION OF THE INVENTION

Figure 1:
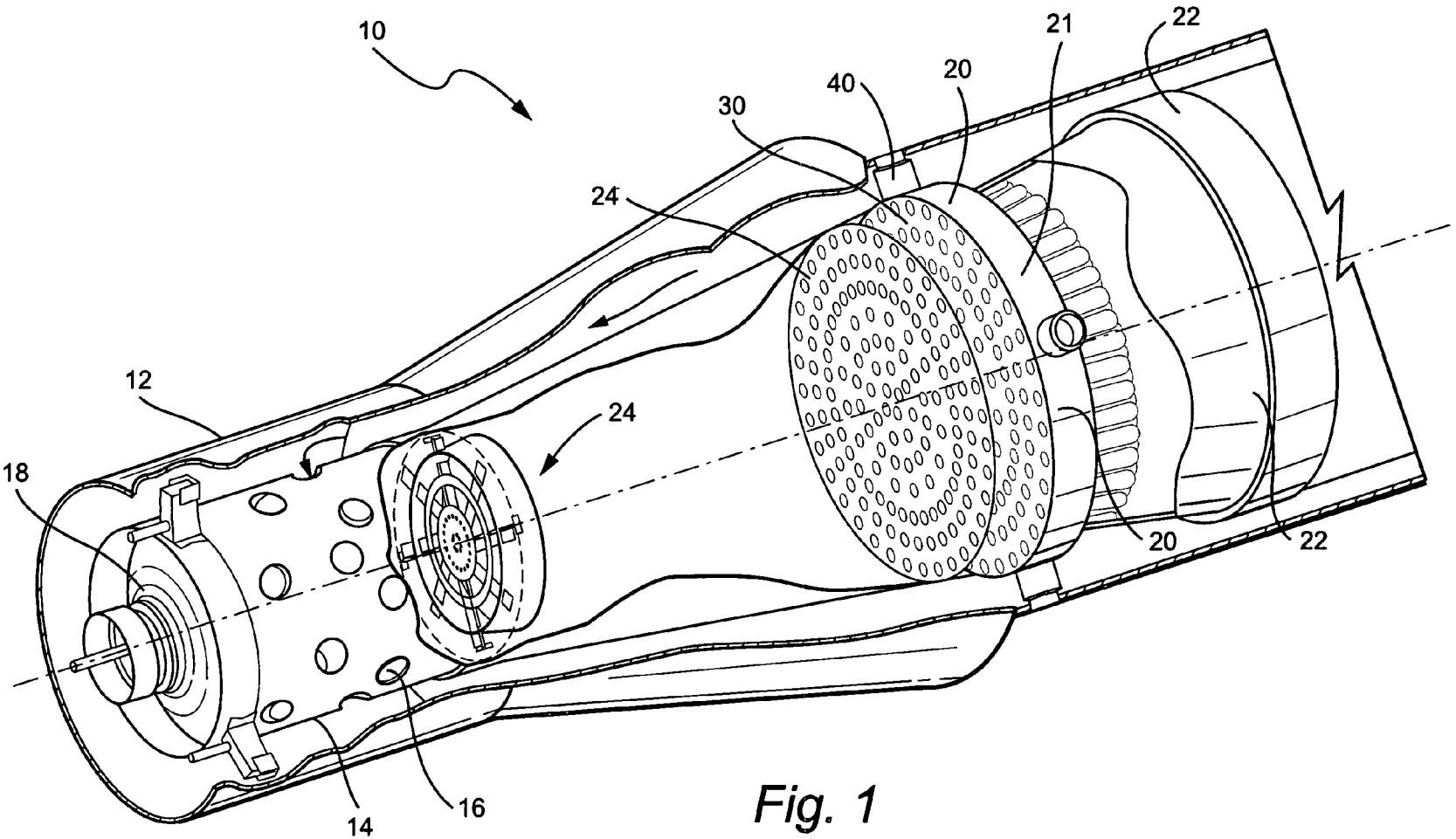
FIG. 1 is a fragmentary perspective view with parts broken out and in cross section illustrating a portion of a catalytic combustor for use in a gas turbine incorporating a multi-venturi tube arrangement according to a preferred aspect of the present invention.

As will be appreciated a typical gas turbine has an array of circumferentially spaced combustors about the axis of the turbine for burning a fuel/air mixture and flowing the products of combustion through a transition piece for flow along the hot gas path of the turbine stages whereby the energetic flow is converted to mechanical energy to rotate the turbine rotor. The compressor for the turbine supplies part of its compressed air to each of the combustors for mixing with the fuel. A portion of one of the combustors for the turbine is illustrated in FIG. 1 and it will be appreciated that the remaining combustors for the turbine are similarly configured. Smaller gas turbines can be configured with only one combustor having the configuration illustrated in FIG. 1.

Referring to FIG. 1 a combustor, generally designated 10, includes a preburner section 12 having an interior flow liner 14. Liner 14 has a plurality of holes 16 for receiving compressor discharge air for flow in the preburner section 12. Preburner section 12 also includes a preburner fuel nozzle 18 for supplying fuel to the preburner section. The flow of combustion products, from the preburner section has a center peaked flow distribution, i.e., both flow velocity and temperature, which does not result in the desired uniform flow to the additional fuel injectors, e.g., the venturi fuel type injectors described and illustrated in U.S. Pat. No. 4,845,952. The main fuel injector is designated 20 in FIG. 1 and forms part of a multi-venturi tube arrangement of which certain aspects are in accordance with a preferred embodiment of the present invention. The air and products of combustion from the preburner section 12 and the fuel from the fuel injector 20 flow to a catalyst or catalytic section 22. As a consequence there is a lack of uniformity of the flow at the inlet to the catalytic section 22. One effort to provide such uniformity, has resulted in the design of a flow controller generally designated 24 between the preburner section 12 and the fuel injector 20. Details of the flow conditioner 24 may be found in U.S. patent application Ser. No. 10/648,203 filed Aug. 27, 2003 for Flow Controller For Gas Turbine Combustors, the subject matter of which is incorporated herein by reference.

At the inlet to the multi-venturi tube arrangement 21 (hereinafter MVT) forming part of the main fuel injector 20, there is provided a perforated plate 24 to assist in conditioning the flow of fuel/air to obtain optimum mixing and uniform distribution of the flows and temperature at the inlet to catalytic section 22.

Figure 2:
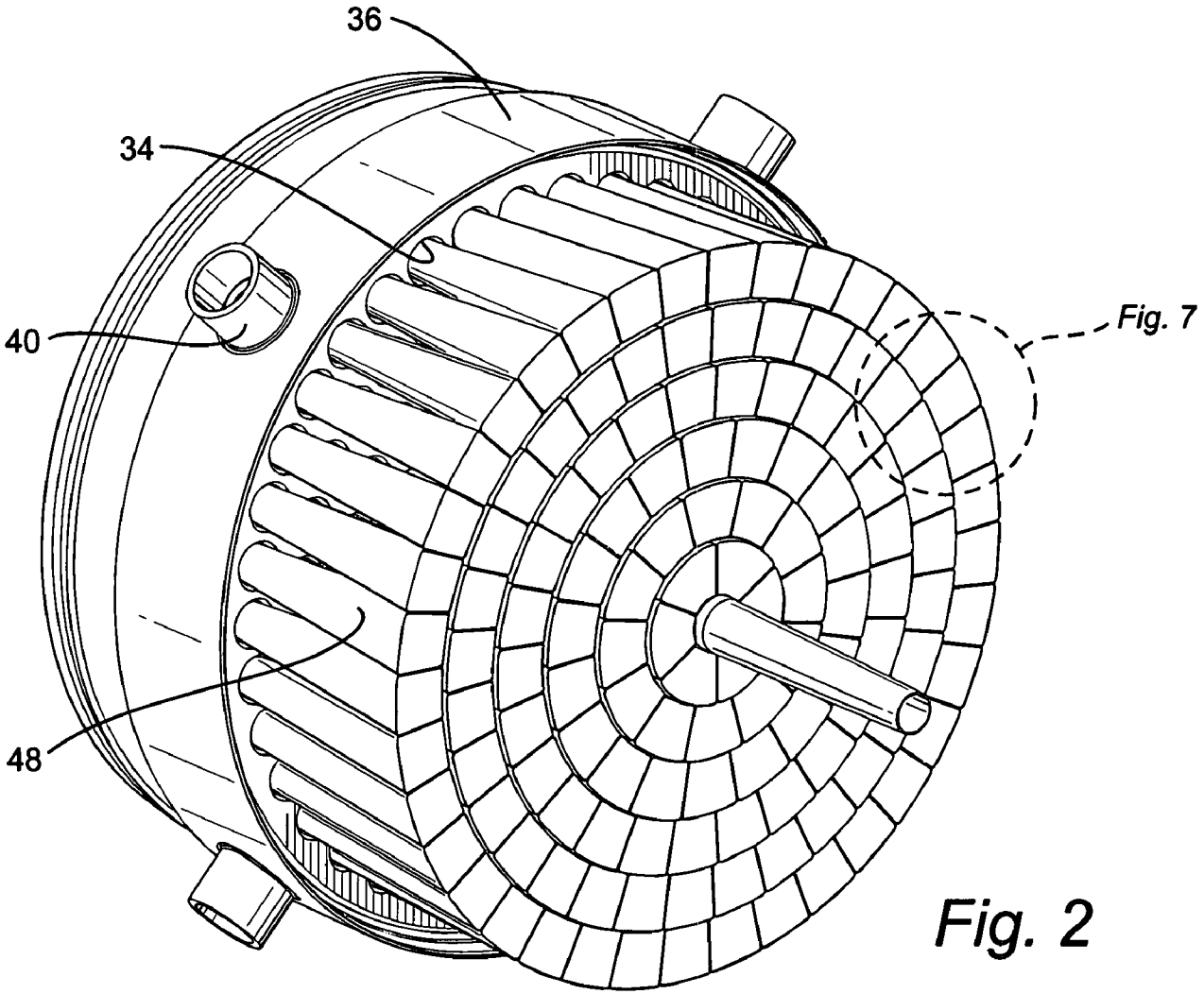
FIG. 2 is a perspective view of the multi-venturi tube arrangement.
Figure 3:
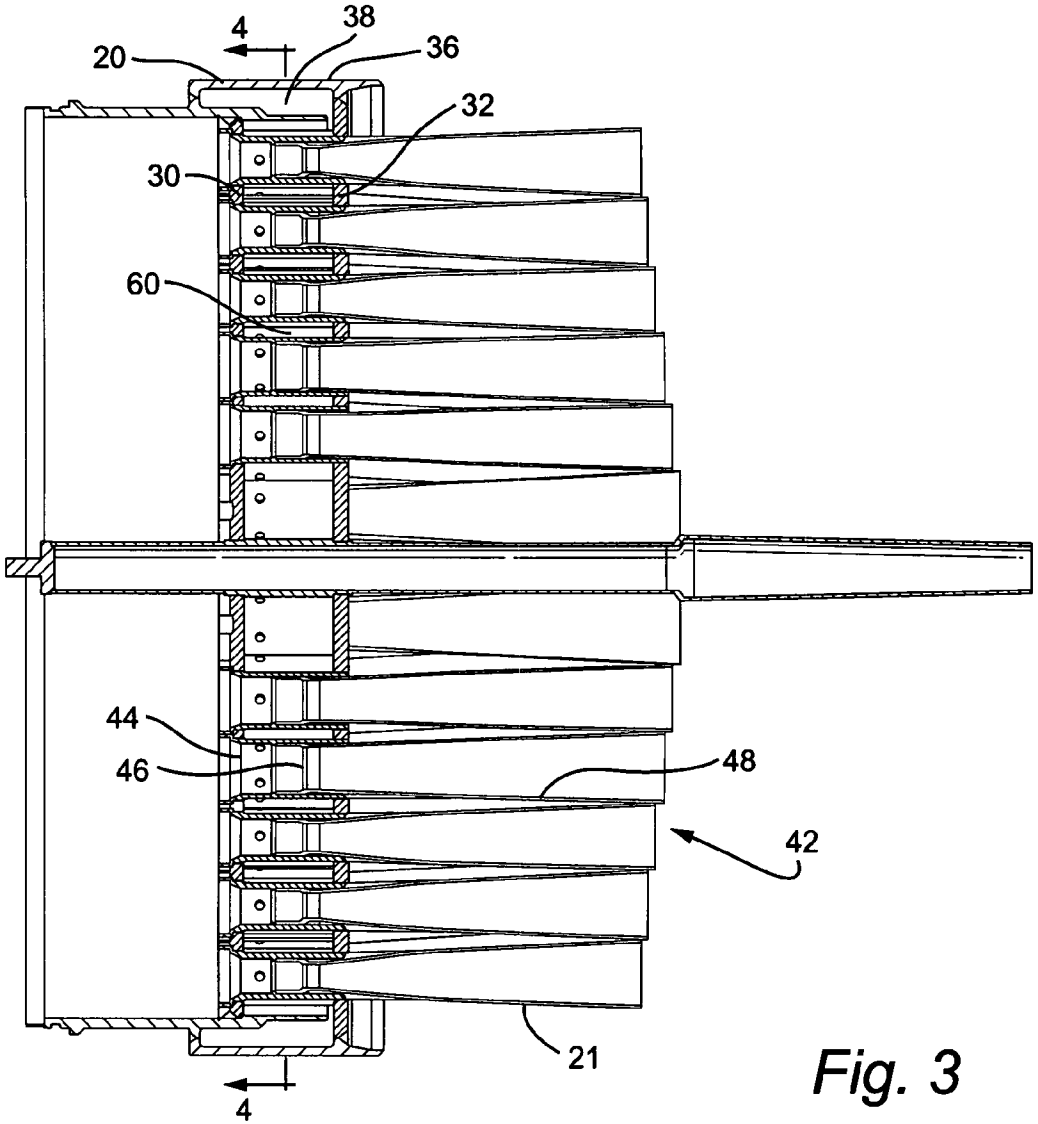
FIG. 3 is a cross-sectional view thereof.
Figure 4:
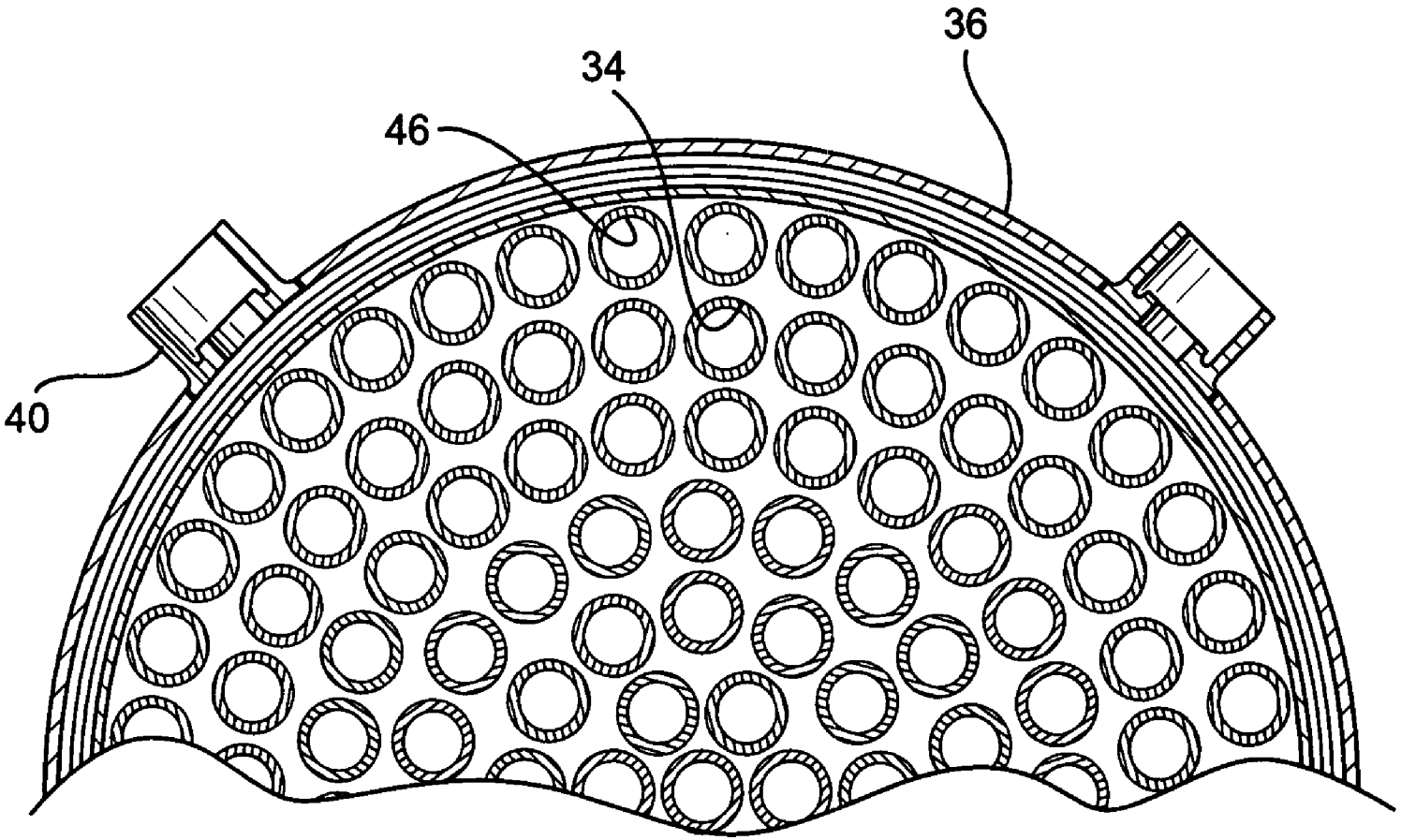
FIG. 4 is a cross-sectional view thereof taken generally about on line 4—4 in FIG. 3.
Figure 5:
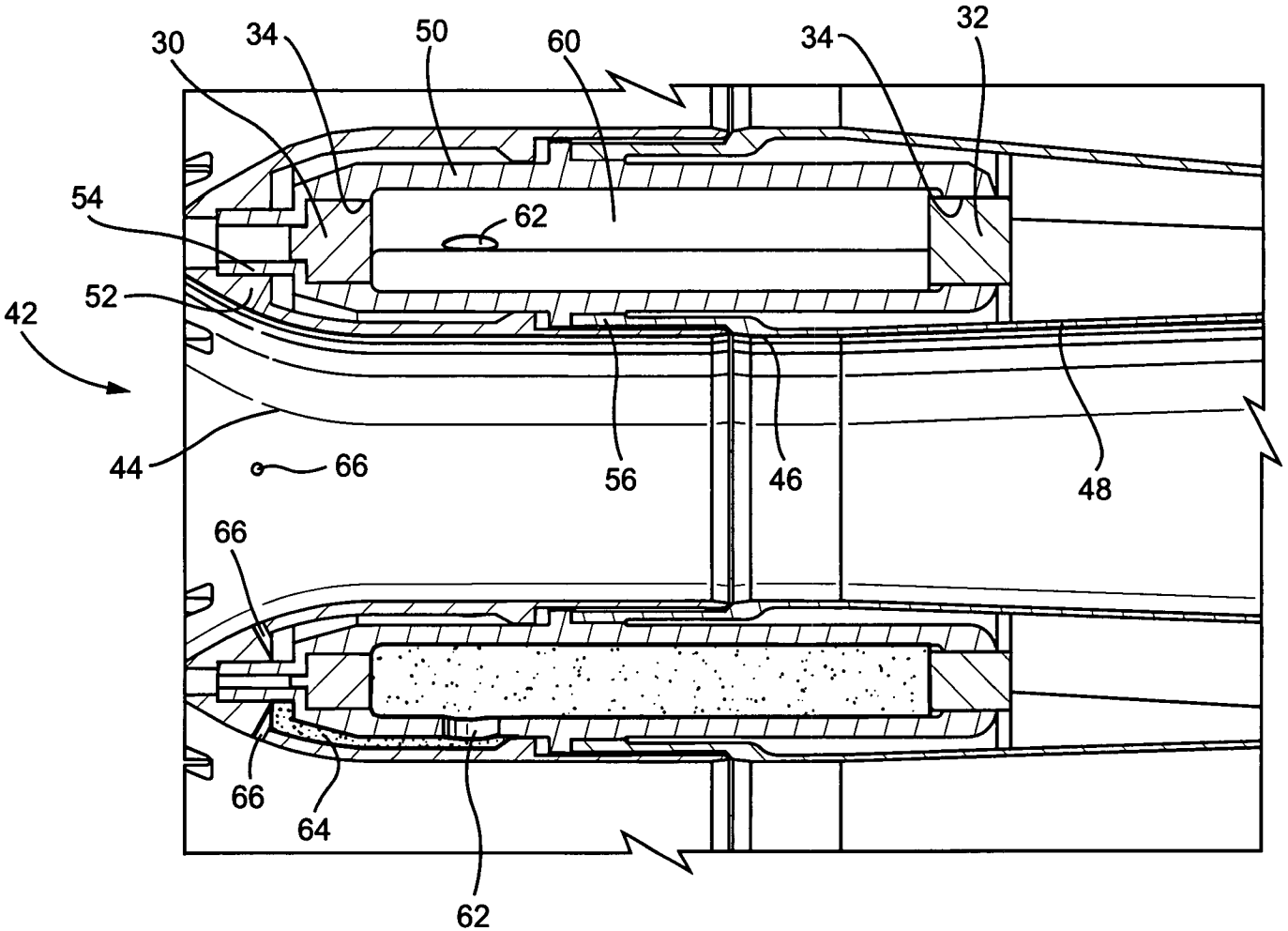
FIG. 5 is an enlarged fragmentary view with parts in cross-section illustrating a venturi and the fuel plenums.

The main fuel injector 20 includes a pair of axially spaced perforated plates, i.e. a front plate 30 and an aft plate 32 (FIGS. 1, 3 and 5). Plates 30 and 32 are perforated and form axially aligned annular arrays of openings, e.g., openings 34 in FIG. 4 of plate 30. A casing 36 defining a plenum 38 surrounds and is secured to the outer margins of the front and aft plates 30 and 32 respectively. As illustrated in FIGS. 2 and 4, a plurality of fuel inlets 40, four being shown, are equally spaced about the periphery of the casing 36 for supplying fuel to the plenum 38.

The openings through the plates 30 and 32 are closed by venturis generally designated 42 and forming part of the MVT 21. Thus each pair of axially aligned openings 34 through the plates 30 and 32 receive a venturi 42. Each venturi includes a converging inlet section 44, a throat 46 and a diverging section or diffuser 48. Inlet section 44 and throat 46 are defined by side walls spaced from the axis passing through openings 34. Each venturi is a three part construction; a first part including the inlet converging portion 44, a second part comprising the throat and diffuser 46 and 48, and a third part comprising an annular venturi member or body 50. Body 50 extends between each of the axially aligned openings in the front and aft plates 30 and 32 and is secured thereto for example by brazing. The converging inlet section 44 of the venturi 42 includes an inlet flange 52 which is screw threaded to a projection 54 of the body 50. The integral throat and diffuser 46 and 48, respectively, has an enlarged diameter 56 at its forward end which surrounds the aft end of the inlet 44 and is secured, preferably brazed, thereto.

It will be appreciated that the space between the front and aft plates 30 and 32 and about the annular bodies 50 of each venturi constitutes a main fuel plenum 60 which lies in communication with the fuel inlets 40. The main fuel plenum 60 lies in communication with each inlet section 44 via an aperture 62 through the annular body 50, a mini fuel plenum 64 formed between the body 50 and the inlet 44 and supply holes 66 formed adjacent the leading edge of the inlet section 44. The fuel supply holes 66 are spaced circumferentially one from the other about the inlet 44 and preferably are four in number. It will be appreciated that the fuel inlet holes 66 to the venturi are located upstream of the throat 46 and in the converging section of the inlet section 44. Significantly improved mixing of the fuel/air is achieved by locating the fuel injection holes 66 in the converging inlet section of the venturi without flow separation or deleterious flame holding events.

Fuel from the fuel inlet plenum 38 circulates between the front and aft plates 30 and 32 and about the annular bodies 50 for flow into the venturis 42 via the fuel apertures 62, the mini plenums 64 between the inlet sections 44 and annular bodies 50 and the fuel inlet holes 66. With the fuel inlet holes located adjacent the inlets to the converging sections of the venturis, the fuel is injected in a region where the air side pressure is higher, e.g., compared to static pressure at the throat. It will be appreciated that the magnitude of the fuel/air mixing taking place in each venturi is directly related to the jet penetration which in turn depends on the pressure ratio across the fuel injection holes 66 and the jet momentum ratio, i.e., between the jets and the main flow stream. To increase the pressure ratio and decouple the fuel injection from airflow distribution, the fuel holes are located upstream of the throat. The fuel is therefore injected in a region where the air-side pressure is higher compared to the static pressure at the throat and therefore, for the same fuel side effective area, the pressure ratio is increased. An optimum pressure ratio-circumferential coverage is achieved. Air velocity is also lower than at the throat and therefore the jets of fuel adjacent the venturi inlet sections 44 develop under better conditions from a momentum ratio standpoint. Further, improved air fuel mixing due to this fuel inlet location is achieved also by the increased mixing length, i.e., the actual travel distance inside the venturi for the same overall length of tube. Additionally, the venturis 42 are fixed between the two plates 30 and 32 to form the main fuel plenum 60 between the plates and the outside surfaces of the venturis. Fuel is introduced into plenum 60 from the outside diameter. A general flow of fuel with some axial symmetry occurs from the outside diameter of the plenum toward the center of the MVT as the venturis are fed with fuel. Thus, a potential imbalance in fuel flow around the tubes and among the tubes with a penalty in mixing performance which occurs with fuel injection at the venturi throats is avoided since the fuel injection holes into the venturis are spatially displaced from a plane in which the general plenum flow occurs. Finally, because the fuel inlet injection holes 66 are located adjacent the venturi inlet section 44, the potential for fuel jet induced flow separation inside the venturis is greatly reduced.

Figure 7:
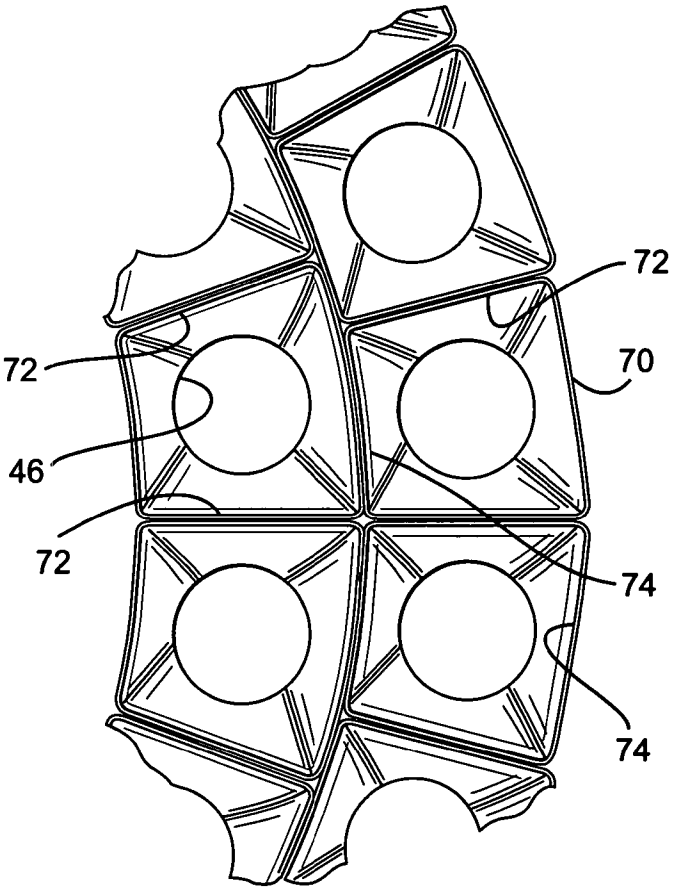
FIG. 7 is an enlarged fragmentary end view of the diverging sections of the multi-venturi tubes as viewed in an upstream direction.
Figure 6:
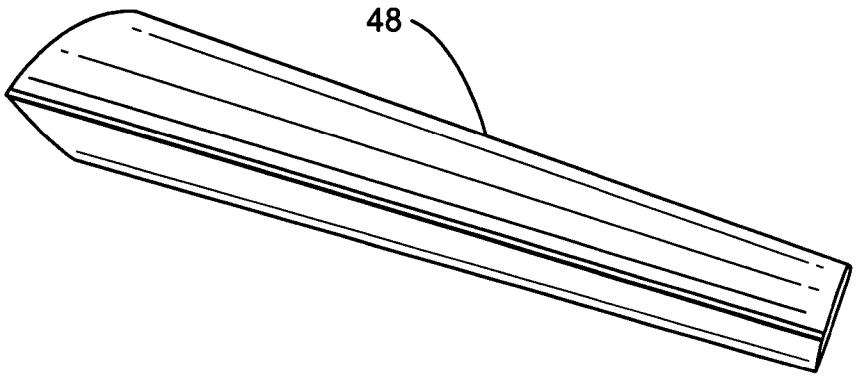
FIG. 6 is a fragmentary perspective view of a portion of the diverging tube of the venturi.

Referring now to FIGS. 2, 6 and 7, each diffuser 48 transitions from a circular shape at the throat 46 to a generally frustum shape at the exit. That is, the diffuser 48 transitions from a circular shape at the throat into multiple discrete angularly related sides 70 (FIG. 7). Sides 70 terminate in circumferentially spaced radially extending side walls 72 as well as radially spaced circumferentially extending arcuate side walls 74 opposite one another. As illustrated, the diffusers 48 are arranged in circular patterns to achieve an axisymmetric geometry by transitioning from circular throat areas to generally frustum areas at their exits. Any gaps between the adjacent venturis both in a radial and circumferential directions are substantially eliminated as can be seen in FIGS. 2 and 7. Thus, as illustrated in FIG. 7, the radial extending walls 72 of each diffuser at each venturi exit lie in contact with and are secured to the corresponding wall 72 of the circumferentially adjacent diffusers. Similarly, the arcuate walls 74 of each diffuser exit lie in contact with adjacent walls 74 of the next radially adjacent diffuser exit. Also, the venturis are arranged in a pattern of circular arrays at different radii about the axis. Thus, gaps between the radially and circumferentially adjacent diffuser exit walls are minimized or eliminated at the exit plane. Previously, for example, as illustrated in U.S. Pat. No. 4,845,952, the exit plane of the venturi diffusers had large gaps between the circular exits. Those interventuri gaps produced large recirculation regions downstream of the exit plane which are filled in by the exit flow from the circular venturis. By transitioning from the circular cross-section at the throat of the venturis to generally frustums at the exit plane of the venturis with minimized or eliminated gaps between circumferentially and radially adjacent venturi exits, these prior large recirculation regions formed downstream of the venturi exits and the risk for flame holding are greatly reduced or eliminated. It will also be appreciated that by providing each venturi in a multi part construction, i.e., an inlet 44 and a combined throat and diffuser section 46, 48, the inlet 44 can be removed for tuning, refurbishing or testing flexibility purposes.

Further, from a review of FIG. 3, the venturi exits are stepped towards the outside diameter and in an upstream direction. That is, the venturi exits are spaced axially increasing distances from a plane normal to the flow through the combustor in a radial outward upstream direction. This enables any gap between adjacent venturis to be further reduced. Also, by making the radial outer venturis shorter, the angle of the exit diffuser is reduced, e.g. to about 7.8° thereby reducing the potential for flow separation in the exit diffuser.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a combustor for a gas turbine, a main fuel injector comprising at least one venturi including a convergent inlet, a throat, and a diffuser for flowing a fuel/air mixture therethrough in a generally axial direction for exit from said diffuser, said inlet having at least one fuel supply hole for supplying fuel into said venturi at a location axially upstream from said throat, and a plurality of fuel supply holes spaced one from the other about said inlet at locations axially upstream from said throat.

2. An injector according to claim 1 wherein said inlet and said throat are circular in cross-section.

3. An injector according to claim 1 wherein said one fuel supply hole is located axially closer to a plane normal to and passing through an inlet opening of the convergent inlet than a plane passing through and normal to the throat.

4. In a combustor for a gas turbine, a main fuel injector comprising:

an array of venturis each including a convergent inlet, a throat, and a diffuser for flowing a fuel/air mixture therethrough in a generally axial direction for exit from said diffuser, a forward plate and an aft plate surrounded by an enclosure defining a fuel supply plenum between said plates;

each said plate having a plurality of openings for receiving the venturis;

each said venturi inlet having at least one fuel supply hole for supplying fuel from said fuel supply plenum into said venturi at a location axially upstream from said throat.

5. An injector according to claim 4 including a secondary plenum in communication with said fuel supply plenum and said fuel supply holes.

6. An injector according to claim 5 wherein each said venturi includes a venturi member about said convergent inlet, said member including an aperture in communication with said secondary plenum for supplying fuel thereto, said secondary plenum lying between said inlet and said member.

7. An injector according to claim 6 wherein said member and said inlet of each venturi are screw-threaded to one another.

8. An injector according to claim 6 wherein said member and said forward and aft plates are brazed to one another.

9. An injector according to claim 4 wherein said one fuel supply hole in said inlet is located axially closer to an entrance to said inlet than the throat.

10. In a combustor for a gas turbine, a main fuel injector comprising at least one venturi including a convergent inlet and a throat about an axis, and a diffuser for flowing a fuel/air mixture therethrough in a generally axial direction for exit from said diffuser, said convergent inlet being defined by a side wall spaced from said axis and having at least one fuel supply hole through said side wall for supplying fuel into said venturi at a location axially upstream from said throat.

11. An injection according to claim 10 including a plurality of fuel supply holes spaced one from the other about said inlet side wall at locations axially upstream from said throat.

12. An injector according to claim 10 wherein said inlet and said throat are circular in cross-section.

13. An injector according to claim 10 wherein said one fuel supply hole is located axially closer to a plane normal to and passing through an inlet opening of the convergent inlet than a plane passing through and normal to the throat.

14. An injector according to claim 10 including a forward plate and an aft plate surrounded by an enclosure defining a fuel supply plenum between said plates;

said plate having an opening for receiving the venturi;

said one fuel supply hole lying at a location axially upstream from said throat for supplying fuel from said fuel supply plenum into said venturi.

* * * * *